United States Patent [19]

Hurst et al.

[11] 4,015,314

[45] Apr. 5, 1977

[54] YARN TAPE DEWEAVING METHOD AND APPARATUS

[75] Inventors: William Dan Hurst, Dalton, Ga.; Donald E. Huffman, Chattanooga, Tenn.; Hermon A. King; Jack Puckett, both of Dalton, Ga.

[73] Assignee: Dixie Yarns, Inc., Chattanooga, Tenn.

[22] Filed: Feb. 11, 1976

[21] Appl. No.: 657,056

[52] U.S. Cl. ..... 28/17; 28/72.16; 242/18 R

[51] Int. Cl.[2] ..... D04B 19/00; D03J 1/04

[58] Field of Search ..... 28/1 R, 17, 18, 72.16; 242/35.5 R, 128, 158 R, 18 R

[56] References Cited

UNITED STATES PATENTS

| | | | |
|---|---|---|---|
| 2,779,084 | 1/1957 | Kastrinsky | 28/17 |
| 3,166,261 | 1/1965 | Loflen | 242/18 R |
| 3,413,700 | 12/1968 | Abowitz | 28/17 |
| 3,696,476 | 10/1972 | Mildon | 28/17 |
| 3,930,357 | 1/1976 | Gibson | 28/72.16 X |

*Primary Examiner*—Louis K. Rimrodt
*Attorney, Agent, or Firm*—Stevens, Davis, Miller & Mosher

[57] ABSTRACT

Disclosed is a method and apparatus for removing a filler thread from a multiple end yarn tape. The yarn tape containing a filler thread is passed over an elongated framework which defines a filler thread removal region. In this region the filler thread is removed from the tape and taken up on a Gilbos winder. The yarn ends are separated downstream of the removal region and wound up on separate take-up spools resting on pairs of driven rollers; the take-up spools are frictionally driven by the positively driven rollers. Means are provided to adjust the speed of the Gilbos winder relative to the yarn tape speed to maintain the removal point of the filler thread from the tape within the defined thread removal region. Further means are provided to shut down the entire apparatus when a break in the filler thread being removed from the yarn tape is detected.

9 Claims, 5 Drawing Figures

YARN TAPE DEWEAVING METHOD AND APPARATUS

BACKGROUND OF THE INVENTION

This invention relates to a method and apparatus for automatically removing filler thread from a multi-end yarn tape and for thereafter taking up the individual yarn ends on corresponding take-up spools.

The deweaving technique of this invention was developed primarily for use with a continuous run dyeing process; however, it may be used with any yarn processing method which utilizes a plurality of yarn ends held together in a flat package by a filler thread, called a "lease", which essentially weaves the yarn ends together. A multi-end yarn tape yarn construction of this type is particularly useful in continuous run bath dyeing where the tape is run through a dying apparatus in which one or more dyes are applied to the yarn by a roller application technique.

In a multi-end yarn tape, a plurality of yarn ends, for example, 40 to 80 ends, of approximately equal length are woven together in the form of a tape by the leasing or filler thread. This tape forming technique is described in U.S. Pat. No. 3,605,225, issued Sept. 20, 1971 to K. H. Gibson et al. A problem which has developed in using multi-end yarn tapes of this type and which has inhibited the use of such tapes in continuous-run dyeing is that it has been necessary to remove the filler or leasing thread by hand. This is an extremely time-consuming operation which has led many dyers to stay away from the use of such tapes. Moreover, even after the tape has been deleased by hand, it has then been necessary to perform several different operations separately. For example, after the leasing thread has been removed, the ends are separated on a machine which runs each yarn end into a separate container. These containers are then transferred to a winding apparatus which takes the yarn out of the container and winds it onto a spool. If the yarn wound on this spool does not have the required degree of uniformity for shipment, it must then be taken to another winder which winds the yarn end onto a further spool or a cone with the degree of uniformity suitable for shipping to the customer.

The present invention was designed to overcome the former difficulties in manual deleasing and to eliminate at least some of the steps in the above-described operation. With the use of this invention, the continuous-run dyeing techniques have become both practical and economically feasible.

SUMMARY OF THE INVENTION

The multi-end yarn tape is threaded onto the deweaving apparatus and the filler thread is wound onto a Gilbos winder modified to provide a motor speed control based on the tension on the filler thread. The yarn tape follows a path which takes it first through an overhead channel, then around a first guide which reverses the direction of tape movement, around tension members, and over a kiss roll which applies an antistatic emulsion. Downstream of this point, the filler thread is separated and is wound onto the Gilbos winder, passing first through a large eye connected to a microswitch control rod which provides on/off control of the winder motor. (In a modified version, this control rod may be connected to a rheostat to provide continuous motor control.) After passing through the eye, the filler thread passes through a guide hole on the winder and then around various tension members, including a sensor bar which shuts off the winder when the filler thread breaks. The several yarn ends continue across the top of the frame to another set of tension members, and then onto a winding frame which contains at least as many take-up spools as there are yarn ends. In one version of the machine, there are up to 80 take-up locations.

BRIEF DESCRIPTION OF THE DRAWING

FIGS. 1A and 1B show side and top views, respectively, of the deweaving apparatus;

DESCRIPTION OF THE PREFERRED EMBODIMENT

Figure 1A:
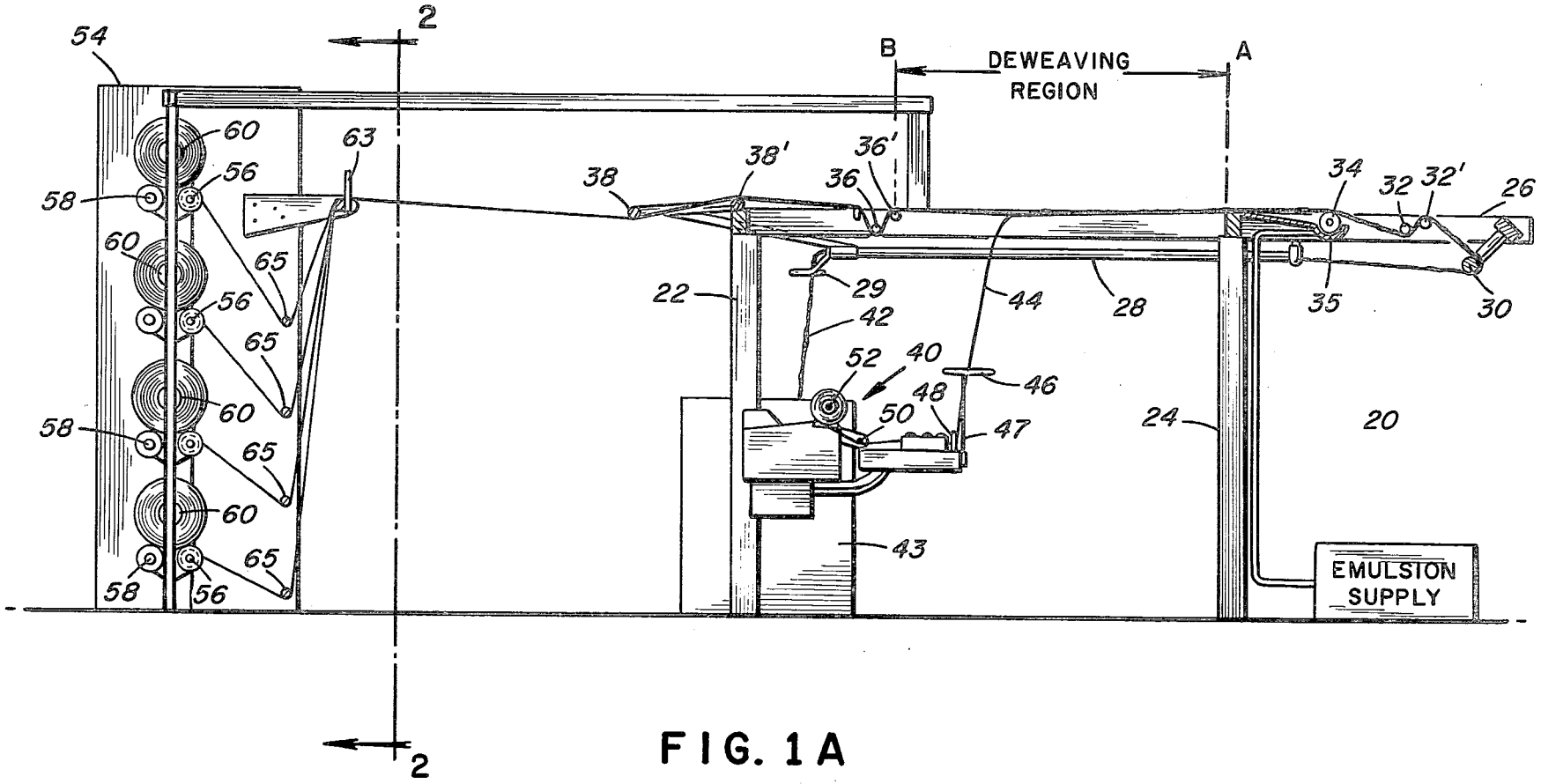

The deweaving or deleasing apparatus, shown in FIGS. 1A and 1B, comprises an open box-like framework 20 having a pair of front legs 22 and a pair of back legs 24; a top pair of parallel frame members 26, 26' rest on legs 22 and 24 and extend rearwardly of back legs 24. The yarn tape feed section of the apparatus includes a channel member 28 mounted to one side of the framework 20 and slightly below top members 26, 26'. A yarn guide member 30 is mounted to and slightly below the rearward end of members 26, 26'. Also mounted to members 26, 26' are a first pair of tension bars 32, 32', a fluid application roller 34, which may be positively driven by a motor 33, a second set of tension bars 36, 36', and a further pair of over-and-under yarn guides 38, 38', the latter being mounted at the front end of the framework 20.

A multi-end yarn tape 42 having a filler thread 44 woven therethrough in the manner described in U.S. Pat. No. 3,605,225 is supplied to the input end of the channel guide 28 through a guide ring 29 from a storage bin 43. The use of the storage bin is merely representative; the yarn tape supplied to the deweaving machine could be taken directly from the output of a preceding yarn treating station to maintain continuity of operations. From the channel guide 28, the yarn is passed under and around guide 30 to reverse its direction of travel, between over-and-under tension bars 32, 32' and over application roller 34. This latter roller sits partially immersed in a trough 35 containing an antistatic emulsion. As the yarn tape 42 passes over the roller 34, the emulsion is applied to the tape to prevent a static electric charge from accumulating on the yarn ends as they are wound onto take-up spools. Motor 33 may, in addition to driving roller 34, act as a pump to supply emulsion fluid from container 37 to trough 35.

A thread take-up apparatus comprising a Gilbos winder 40 is mounted between the front legs 22 of framework 20 and below the upper frame members 26. The motor drive control circuit of the winder is modified for use in this invention in a manner described below. Downstream of the roller 34, the filler thread 44 is separated from the yarn tape in the filler thread deweaving or removal region (defined between points A and B in FIG. 1B) and passed through a large eye ring 46 mounted on the end of an arm 47 which is connected to the Gilbos winder motor drive circuit. The location on the yarn tape where the end of the filler thread is pulled out of the tape will, for convenience, be referred to hereafter as the "removal point". This removal point moves back and forth within the filler thread removal region as a function of the relative winder and yarn tape speeds. Downstream of the removal point, the filler thread 44 is passed through a hole in a guide member 48, under a limit switch tension bar 50 and onto the takeup spool 52 of the winder. The yarn tape, downstream of the removal point, is trained around over-and-under tension bars 36, 36' and over-and-under guides 38, 38' to be taken up separately on individual take-up spools.

Figure 2:
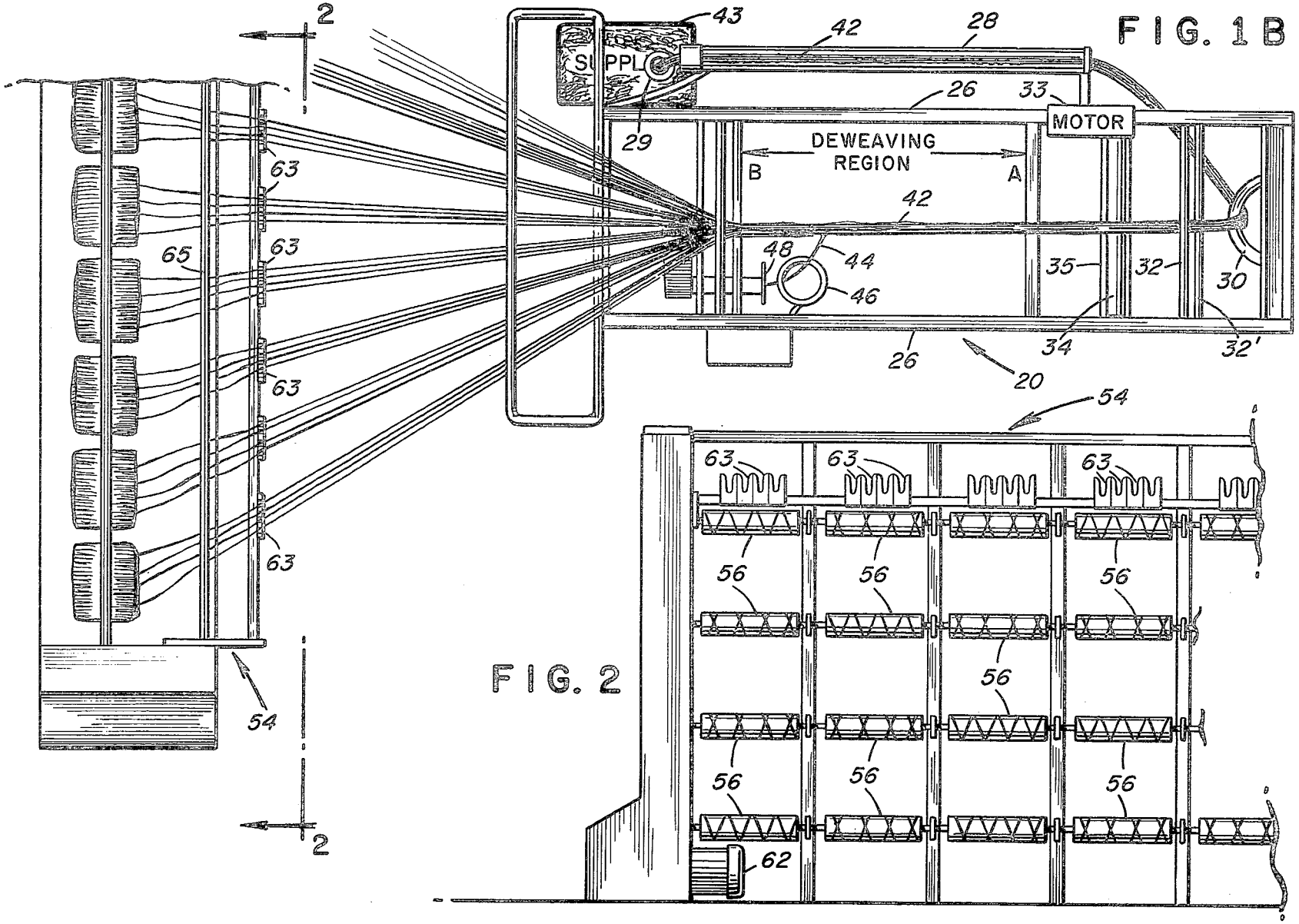
FIG. 2 shows a portion of the take-up frame and rollers.

The take-up section includes a take-up frame 54 on which are mounted sets of rollers 56, 58. Rollers 58 need not have the same length as rollers 56; in one embodiment they are in fact approximately five times the length of a roller 56. For convenience, however, they may be considered as roller pairs. Yarn takeup spools 60 are provided to separately take up the individual yarn ends following removal of the filler thread from the tape. Each spool 60 rests on a corresponding pair of rollers 56, 58 and is driven by the frictional engagement of spool 60 with roller pairs 56, 58. This frictional drive arrangement is an important feature of this invention as will be made clear below. As shown in FIG. 2, the roller pairs are arranged in columns and rows and are driven by motor 62 through any known drive transmission mechanism, such as a gearchain drive arrangement. The roller pairs are geared such that rollers 56, which have cammed surfaces to guide the yarn ends onto the spools 60 evenly, have a higher rotational velocity than do rollers 58, which are smooth surfaced. It was determined that the cammed rollers 56 should rotate about 5–15% faster than the smooth rollers 58; preferably the ratio $V_c$:$V_s$ is on the order of 13:12, where $V_c$ is the rotational velocity of the cammed roller 56 and $V_s$ is the rotational velocity of the smooth roller 58. It was found that this velocity relationship is desirable to keep the spool 60 properly seated in engagement with its roller pair.

Mounted on the frame 54 is a yarn guide having a plurality of comb-like members 63. Also mounted on the frame 54 are guide bars 65. Yarn ends passing through the guide paths of comblike members 63 are trained under and around a guide bar 65 so that a yarn end will pass over the cammed surface of a roller 56 at the proper angle of wrap, which is preferably on the order of about 120°; the distance from guide bar 65 to the center of the corresponding roller 56 is about 24 inches.

Figure 3:
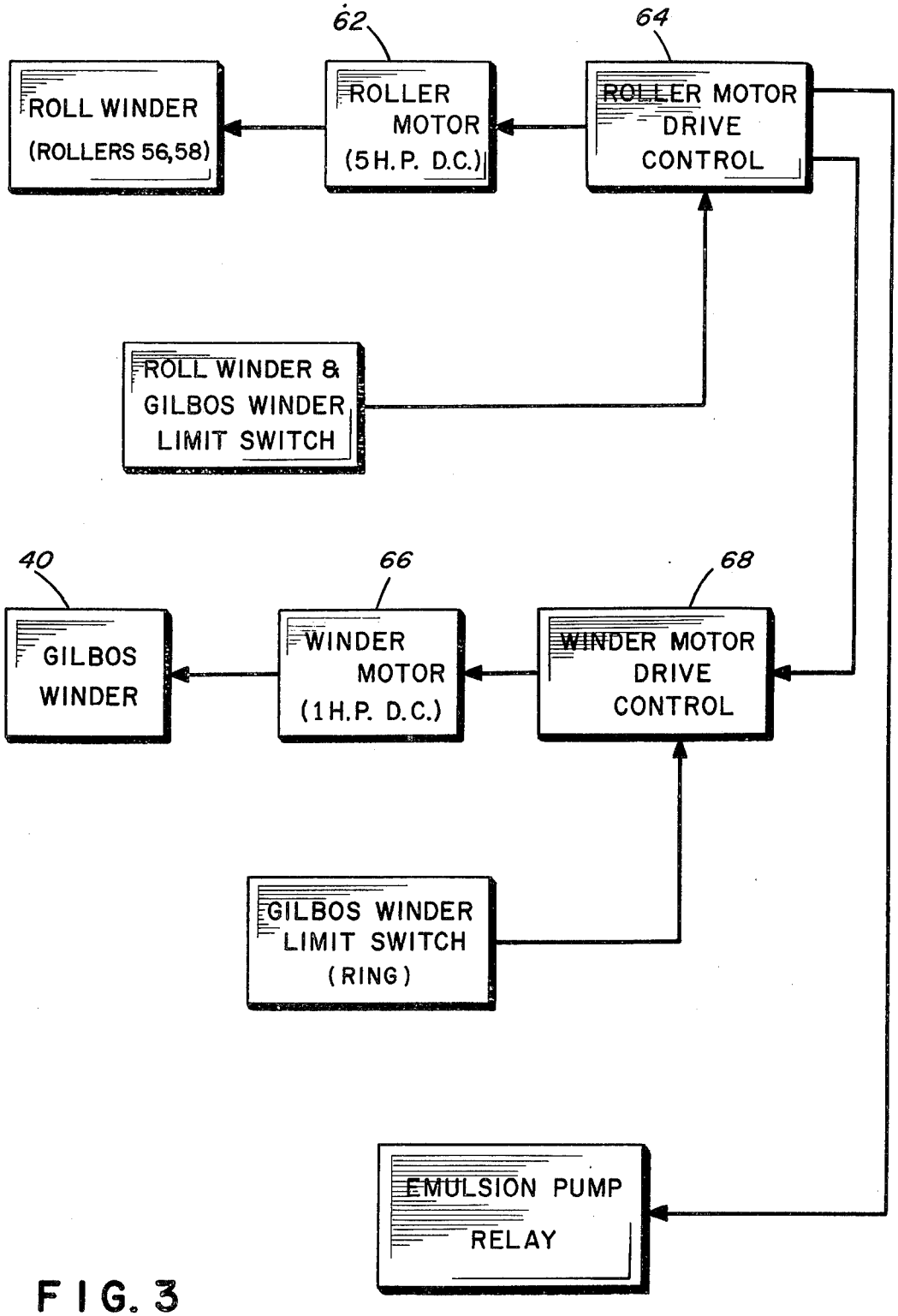
FIG. 3 is a block diagram of the electrical circuit of this invention.
Figure 4:
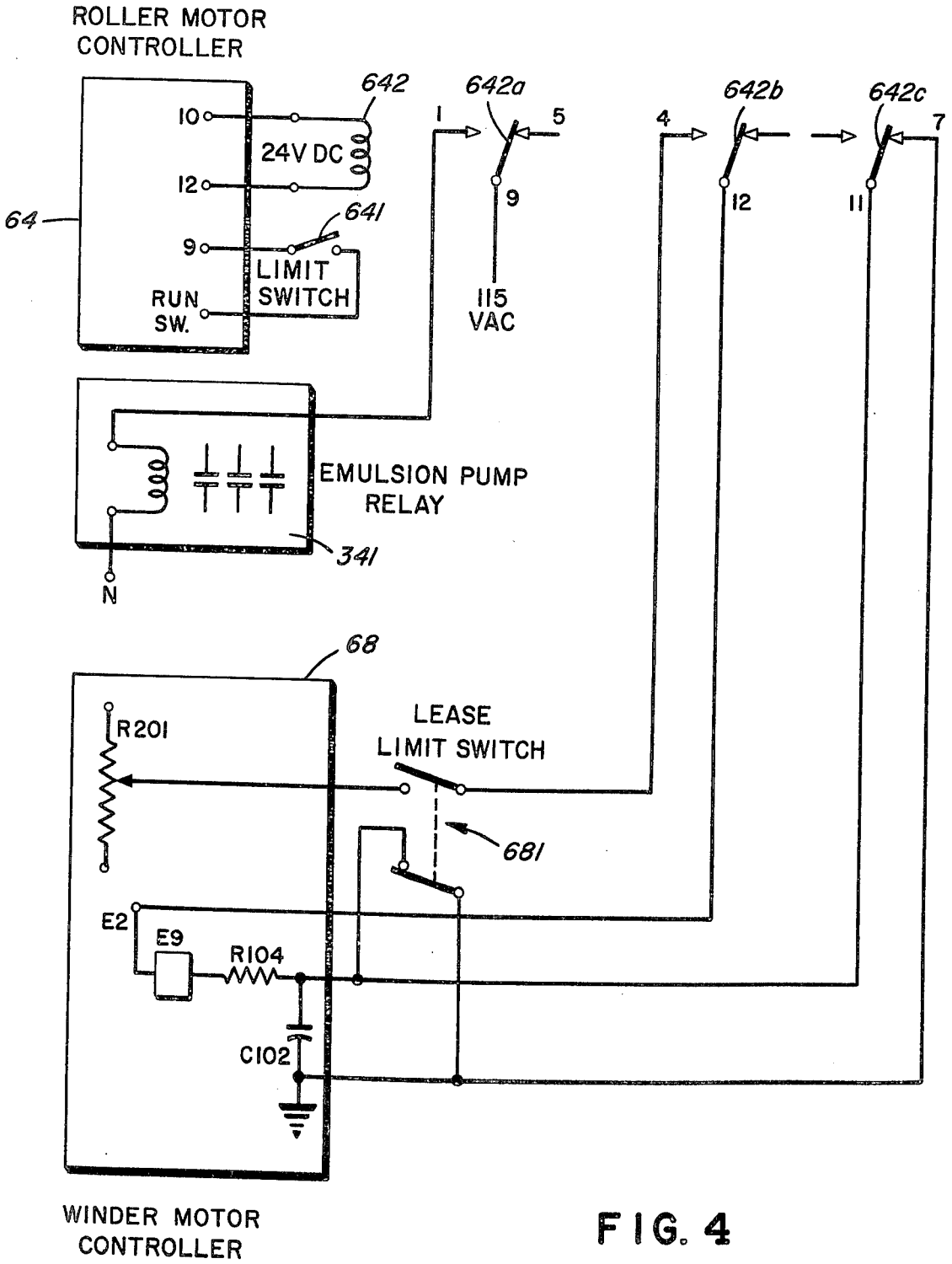
FIG. 4 shows details of the motor control devices.

The electrical system for the apparatus of this invention is shown in FIGS. 3 and 4. FIG. 3 shows the overall block diagram of the electrical system. The roller pairs 56, 58 are driven by a 5 HP D.C. motor 62 coupled to a D.C. drive controller 64. The Gilbos winder 40 is driven by a 1 HP D.C. motor 66 coupled to a D.C. drive control 68. In the disclosed embodiment, the motor control unit 64 is a Model WER ES-125 packaged drive made by Wer Industrial, a division of Emerson Electric Company. The motor control unit 68 is the Cadet Series 330B SCR adjustable speed drive system, available commercially from Morse Chain, a division of Borg-Warner Corporation. For use in this invention, the Wer Electrostat and Morse Cadet controllers have been modified as shown in FIG. 4. (The terminal numbers indicated in FIG. 4 correspond to the similarly numbered terminals indicated in the schematics of the Wer "Electrostat 125" instruction manual, dated February, 1974 and the Morse "Cadet Series" operating manual, dated December, 1972.)

The ES-125 controller has a RUN switch which, when engaged, permits the motor 62 to accelerate to the speed set by the operator. As modified for this invention, a limit switch 641, connected to and operated by tension bar 50, is interposed in series with the RUN switch to automatically shut down the motor 62 if a break should occur in the filler thread as it is being wound onto the Gilbos winder 40. Limit switch 641 remains closed as long as the tension bar 50 is held up by tension on the filler thread being wound onto the winder take-up spool 52. When a break occurs in the filler thread, tension on the bar 50 is relaxed and switch 641 opens to shut down the yarn take-up motor 62. Connected to terminals 10 and 12 of the RUN start circuit of the ES-125 controller is a 24-volt D.C. relay coil 642 having at least three sets of contacts **642*a*, 642*b* and 642*c*. As long as the take-up motor 62 is in the RUN state, and limit switch 641 is closed, coil 642 remains energized. Contacts 642*a* will be closed to energize the emulsion pump relay 341 (and thus motor 33) to pump emulsion fluid into the emulsion roller trough 35. At the same time, contacts 642*b* close and 642*c* open to permit winder motor 66 to be controlled by means of the speed control potentiometer R201 in the Morse Cadet D.C. drive controller 68.**

The Morse drive controller 68 is modified as shown in FIG. 4 by the addition of a lease limit switch 681. Opening and closing of limit switch 681 is controlled by the movement of the eye 46 and rod 47; switch 681 opens (as shown in FIG. 4) to shut off motor 66 when sufficient tension is applied by the filler thread 44 against eye 46 (i.e. when the removal point of the thread 44 on the yarn tape 42 is adjacent point A). This occurs when the filler thread is being removed from the tape at too fast a rate relative to the rate at which the yarn tape is being pulled through the deweaving apparatus.

When limit switch 641 opens upon the occurrence of a break in the filler thread 44 being wound onto the winder spool 52, relay 642 is de-energized and contacts **642*b* and 642*c* return to the states shown in FIG. 4 to cut off winder motor 66. In the embodiment described above, the lease limit switch 681 controlled by the loop 46 provides only on/off control of the winder motor 66. This control may be modified by replacing the limit switch 681 with a potentiometer arrangement to provide continuous winder motor speed control, from fully on to fully off, as a direct function of the tension imparted by the filler thread 44 to the loop 46.**

In operation, the take-up spools 60 draw the yarn tape out of the storage bin 44, through the deweaving apparatus and onto the spools 60. At the same time, the filler thread 44 is drawn out of the yarn tape 42 by the winder 40.

Key aspects of this invention reside in 1) the speed relationship amoung the take-up spools 60 taking up the individual yarn ends of tape 42 and 2) the speed relationship of the take-up spools 60 to the take-up of the filler thread 44 on spool 52. It is found that when the yarn tape 42 is made up with the filler thread 44 in the manner disclosed in the aforementioned Gibson et al patent, some of the yarn ends are longer than others. Over the total length of the yarn tape, the differential between yarn ends within the tape can run to several feet or more. The yarn end take-up system of this invention allows each end to be individually taken up at its own speed so that the overall speed of the yarn tape as it moves through the deweaving apparatus remains relatively constant.

As noted above, each take-up spool 60 merely rests on the two rollers 56 and 58 and is caused to rotate by the frictional drive imparted by these two rollers. The rotational speed of a given spool 60 is determined by the back tension on that spool applied by the yarn end being wound thereon; the greater the tension on the yarn end, the slower the take-up spool will rotate. Thus a longer yarn having some slack as compared to the other ends within the tape will impart less tension to its take-up spool, thereby permitting that spool to rotate faster than the spools taking up the shorter ends. The longer end is therefore taken up faster and in essence catches up with the shorter ends, thereby maintaining the desired uniform tension throughout the system and the uniform velocity of the tape.

After the operator initially threads each yarn end onto its appropriate take-up spool 60 and the filler thread onto the take-up spool 52 of the winder, he manually sets the initial speed of the yarn take-up spool driving motor 62 which provides the positive drive for pulling the tape through the deweaving apparatus. The tape speed is maintained relatively constant by virtue of the frictional drive on the individual yarn end take-up spools as described above. At the same time, he sets the initial or nominal speed of the winder take-up motor 66. The speed at which the filler thread 44 is taken up on the winder spool varies as a function of the tension on the filler thread. In the deweaving or filler thread removal region, defined between points A and B in FIG. 1B, the tension on thread 44 decreases as the point where the thread 44 is removed from the tape 42 moves from point A to point B; that is, the tension on thread 44 decreases as the speed at which the tape 42 moves increases relative to the speed at which the thread 44 is removed from the tape. The nominal winder speed is set by taking into consideration the following factors: The maximum take-up speed of the filler thread 44 onto the winder spool 52 must be greater than the speed at which the tape moves through the deweaving region but must not be so great that the removal point occurs upstream of point A. The minimum take-up speed of the winder 40 must not be so low that the removal point moves downstream of point B.

When the filler thread is being taken up too rapidly, that is, it is being pulled out of the tape near the beginning of the deweaving region (adjacent point A), the thread 44 engages eye 46 causing rod 47 to open limit switch 681 to shut off the winder motor. Winder roll 52 does not stop immediately but continues, through inertia, to rotate at a continuously decreasing rotational velocity. The take-up speed of the thread 44 is therefore decreased relative to the tape speed; the removal point of the filler thread from the tape then moves with the tape in the direction from A to B. As the tension imparted by the filler thread 44 on loop 46 thus decreases, the limit switch 681 closes and the winder motor 66 starts up again to increase the speed at which the filler thread is removed from the tape. The nominal filler thread take-up speed is set by the operator relative to the yarn tape speed so that the removal point does not go beyond end point B of the deweaving region.

Although the principles of the present invention have been described above in relation to a particular embodiment, it will be understood that this description has been provided merely by way of example; the scope of the invention is limited solely by the hereafter appended claims.

What is claimed is:

1. Apparatus for removing a filler thread from a multiple end yarn tape, comprising:

first means defining a yarn tape path and a filler thread removal region;

yarn end take-up means, located downstream of said first means along said yarn tape path, for separately taking up each end of said multiple end yarn tape and for maintaining a substantially uniform speed of said yarn tape along said path;

filler thread take-up means, located upstream of said yarn end take-up means along said yarn tape path, for removing said filler thread from said tape in said filler thread removal region; and means coupled to said filler thread take-up means for controlling the speed at which said filler thread take-up means removes said filler thread from said yarn tape, including means for preventing the location at which said filler thread is removed from said yarn tape from moving outside said filler thread removal region.

2. The apparatus according to claim 1 further comprising means coupled to said yarn end take-up means and to said filler thread take-up means for detecting a break in said filler thread and shutting off said yarn end take-up means and said filler thread take-up means when said break is detected.

3. The apparatus according to claim 1, wherein said first means comprises a first set of yarn tape tension members and a second set of yarn tape tension members located downstream of said first set along said yarn tape path, said filler thread removal region being defined between said first and second sets of yarn tape tension members.

4. The apparatus according to claim 1, wherein said yarn end take-up means further comprises:

a plurality of roller pairs;

means for driving said plurality of roller pairs such that one roller of each of said pairs is driven at a higher rotational velocity than the other roller of that pair; and a plurality of yarn take-up spools, each take-up spool resting on a corresponding one of said roller pairs and frictionally driven thereby, the rotational velocity of said take-up spools being controlled at least in part by back tension applied by the yarn end imparted to the take-up spool on which that yarn end is being taken up.

5. The apparatus according to claim 4, wherein said yarn end take-up means further comprises guide means associated with each take-up spool and located vertically beneath and upstream of its associated take-up spool, each of said yarn ends being trained under and around a corresponding guide means and taken up on its associated take-up spool.

6. The apparatus according to claim 5, wherein said yarn ends are trained under and around said guide means so as to have an angle of wrap of approximately 120°.

7. The apparatus according to claim 1, wherein said filler thread take-up means further comprises:

a winder onto which said filler thread is wound;

means for driving said winder at speeds greater than a predetermined minimum and up to a predetermined maximum speed; and means for reducing the speed of said winder drive means when the location at which said filler thread is removed from said yarn tape moves upstream of a predetermined reference point determined by the amount of tension on said filler thread.

8. The apparatus according to claim 7, wherein said speed reducing means further comprises an eye through which said filler thread is passed and switch means coupled to said eye for shutting off said winder drive means when the tension imparted by said filler thread to said eye exceeds a predetermined amount.

9. A method for removing filler thread from a multiple end yarn tape, comprising the steps of:

passing said yarn tape through a filler thread removal region;

taking up each of said yarn ends on separate take-up spools;

separately controlling the rotational velocity of said yarn end take-up spools by the amount of back tension imparted to a given spool by the yarn end being taken up thereon, to thereby maintain a relatively uniform speed of said yarn tape moving through said filler thread removal region;

removing said filler thread from said yarn tape by winding said filler thread onto a thread take-up spool; and adjusting the winding speed of said thread take-up spool to maintain the point at which said thread is removed from said tape within said filler thread removal region.

* * * * *